United States Patent [19]

Aichinger

[11] Patent Number: 4,480,761

[45] Date of Patent: Nov. 6, 1984

[54] TAMPER INDICATING CLOSURE FOR A CONTAINER

[75] Inventor: Dietmar Aichinger, Runenberg, Switzerland

[73] Assignee: Albert Obrist AG, Reinach, Switzerland

[21] Appl. No.: 513,909

[22] Filed: Jul. 14, 1983

[30] Foreign Application Priority Data

Jul. 14, 1982 [CH] Switzerland ..... 4280/82

[51] Int. Cl.[3] ..... B65D 41/34

[52] U.S. Cl. ..... 215/252

[58] Field of Search ..... 215/252, 253, 246

[56] References Cited

U.S. PATENT DOCUMENTS 4,345,692 8/1982 Obrist et al. ..... 215/252
4,394,918 7/1983 Grussen ..... 215/252
4,432,461 2/1984 Mumford et al. ..... 215/252

FOREIGN PATENT DOCUMENTS 34997 3/1981 European Pat. Off. .
582099 11/1976 Switzerland .

*Primary Examiner*—George T. Hall
*Attorney, Agent, or Firm*—William R. Hinds

[57] ABSTRACT

A closure cap (1) comprising thermoplastic material has a guarantee strip (4) which is joined to the closure cap by way of desired-rupture web portions (5). Besides the desired-rupture web portions (5) the guarantee strip is also joined to the closure cap by way of a reinforced region which comprises two substantially vertically extending holding web portions (8). The guarantee strip (4) is interrupted by a slot (9) between the two holding web portions so that the guarantee strip forms an open loop and can in any event be readily removed from the neck (3) of the container.

6 Claims, 5 Drawing Figures

TAMPER INDICATING CLOSURE FOR A CONTAINER

The invention relates to a closure cap for a container, which is provided with a guarantee strip that can be brought into engagement with the neck of the container, and which is made in one piece with the guarantee strip from thermoplastic material by an injection moulding process, wherein the guarantee strip is joined to the lower edge of the closure cap by way of a multiplicity of desired-rupture web portions and by way of a reinforced region and the wall thickness of the guarantee strip has a reinforcement in the area between each two desired-rupture web portions.

Closure caps comprising thermoplastic material, with a guarantee strip which can be brought into engagement with the neck of the container, have long been known and are used in preference in the beverages industry. The guarantee strip can either be shrink-fitted on to the neck of the container, or it can be brought into mechanical engagement with the neck of the container, when screwing on the closure cap, for example by engaging behind a bead or raised portion. The present applicants' Swiss patent specification No. 582 099 discloses such a closure cap wherein the reinforced region is in the form of a web of material which still joins the guarantee strip to the closure cap after the desired-rupture web portions have been torn open. That arrangement is intended to prevent the guarantee strip from being left on the neck of the bottle. As the containers are 'multitrip' bottles, it will be seen that if the guarantee strip were to remain on the neck of the container, it would impede the process of cleaning the bottle. The applicants' laid-open European application No. 34 997 discloses a further improved closure cap in which the guarantee strip has a reinforcement in the area between each two desired-rupture web portions. That reinforcement on the one hand facilitates injection moulding of the closure cap and on the other hand provides for particularly advantageous shrinking of the guarantee strip, by the effect of heat applied thereto.

A problem which arises with the known closure caps is that the web of material which acts as a reinforced region to keep the guarantee strip joined to the closure cap, after the operation of tearing the closure open, must be of such a strength that it can no longer be broken off. It will be appreciated however that the consumer wants to remove the guarantee strip which is joined to the closure cap, as the guarantee strip interferes with handling the closure cap when the container is to be re-closed thereby. If however the web of material is excessively weak, there is in turn the danger that the web portion will tear like the other desired-rupture web portions, when unscrewing the closure cap, and the guarantee strip thus remains on the neck of the bottle. In addition, in the case of a guarantee strip which can be shrink-fitted, the relatively massive web of material has the effect that the guarantee strip does not shrink at that position, so that the arrangement is no longer certain to give a guarantee that the closure cap is in its original condition.

An object of the present invention is therefore to provide a screw cap of the kind set forth in the opening part of this specification, wherein, although the guarantee strip remains reliably joined to the closure cap by a reinforced region when the cap is unscrewed, nonetheless the guarantee strip can subsequently be easily torn away from the closure cap. Another object of the invention is to design shrink-fit guarantee strips in such a way that the shrinkage process is not impeded by the reinforced region. According to the invention, such object is attained in that the reinforced region comprises two substantially vertically extending holding web portions and that the guarantee strip is interrupted between the holding web portions.

In that way, the guarantee strip no longer forms a continuous ring but a kind of loop which is still joined to the closure cap in the initial phase of the operation of unscrewing the cap. That also gives the important advantage that, when the closure cap is removed from a moulding tool, in particular an injection moulding tool, the guarantee strip can be radially compressed so as to make it easier to remove the cap. It is particularly advantageous for the cross-section of the two holding web portions together to be larger than that of an individual desired-rupture web portion. In that way, when unscrewing the cap, all the desired-rupture web portions are ruptured first, so that for the time being the guarantee strip remains joined to the closure cap only by way of the two holding web portions. However, as the operation of unscrewing the cap is continued, one of the two holding web portions is also ruptured, with the guarantee strip however still remaining joined to the closure cap. The remaining holding web portion can now be readily broken away from the lower edge of the closure cap, by hand.

The guarantee strip can be shrunk onto the neck of the container in a particularly advantageous manner, if the two holding web portions are arranged in the region between two reinforcements on the guarantee strip. In that way, the holding web portions also shrink onto the neck of the container, when subjected to the effect of heat. That is the case in particular when the two holding web portions are of substantially the same wall thickness as the guarantee strip.

An embodiment of the invention is described in greater detail hereinafter and illustrated in the drawings in which.

Figure 1:
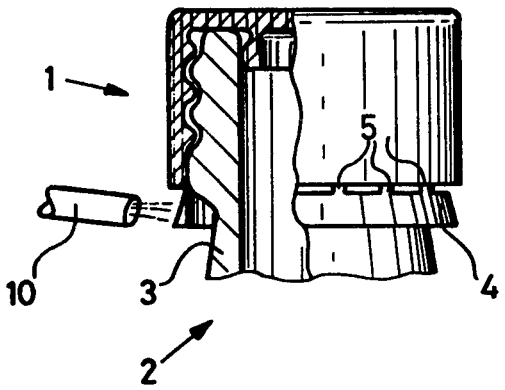
FIG. 1 shows a closure cap being shrink-fitted onto the neck of a container.
Figure 2:
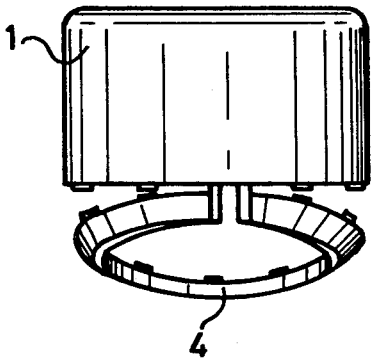
FIG. 2 shows a closure cap with the guarantee strip partly pulled off.

As shown in FIG. 1, a closure cap 1 for closing a container 2 is screwed onto the neck 3 of the container. The closure cap 1 has a guarantee strip 4 which is joined to the lower edge 6 of the closure cap by way of desired-rupture web portions 5. The guarantee strip is shrink fitted onto the neck 3 of the container for example by means of a hot air nozzle 10.

Figure 3:
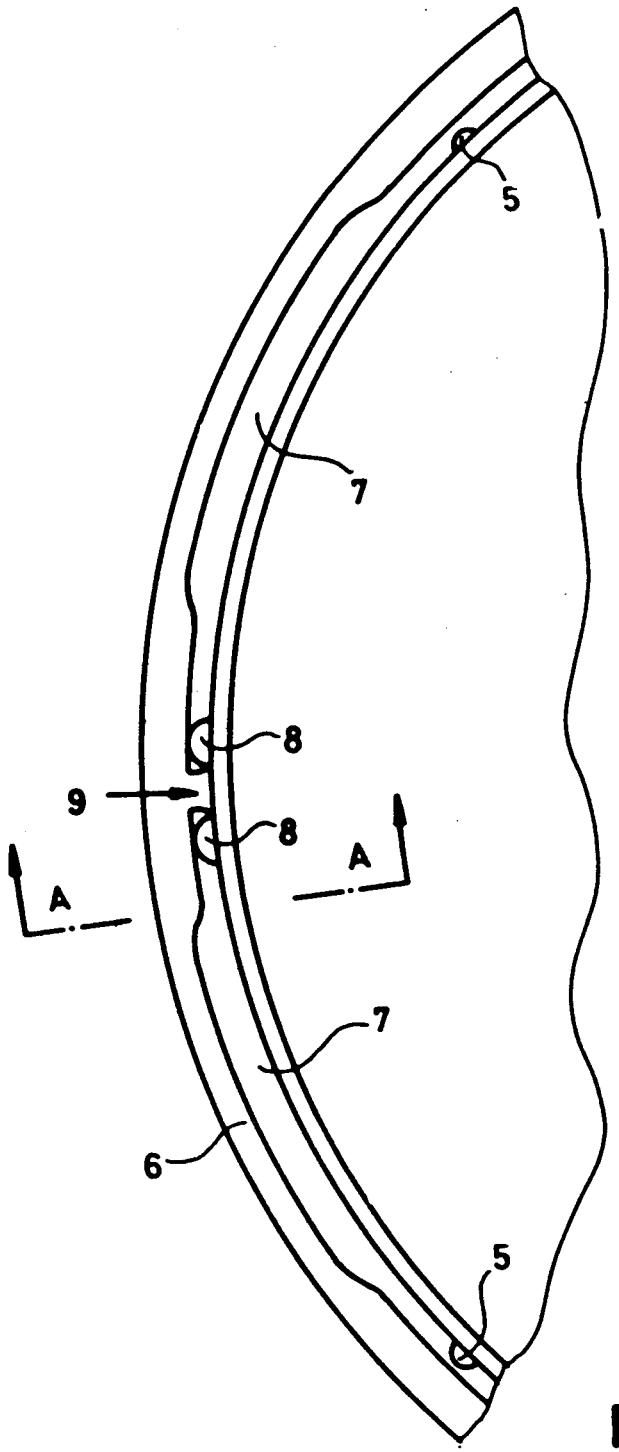
FIG. 3 shows a view from below on a greatly enlarged scale of part of a closure cap.
Figure 4:
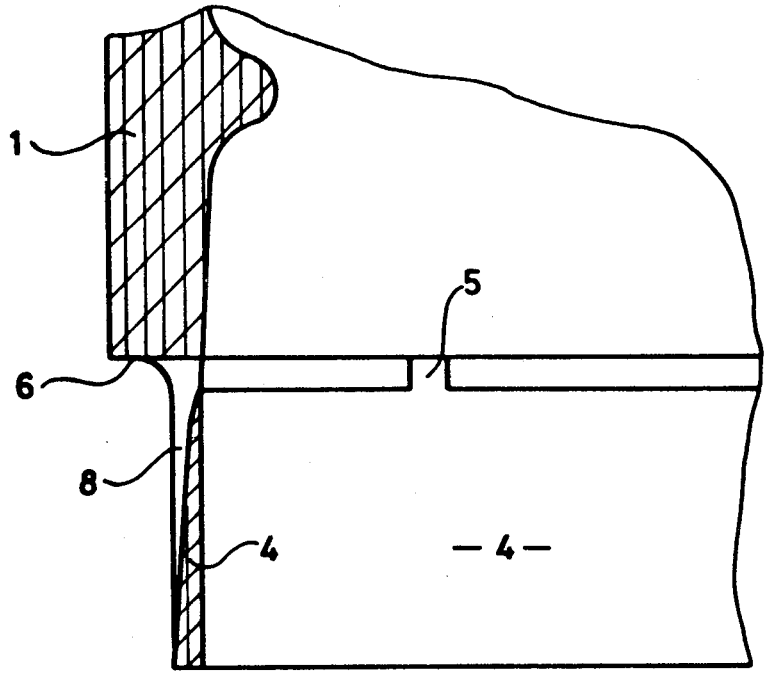
FIG. 4 shows a view of part of the closure cap in cross-section taken along line A—A in FIG. 3.
Figure 5:
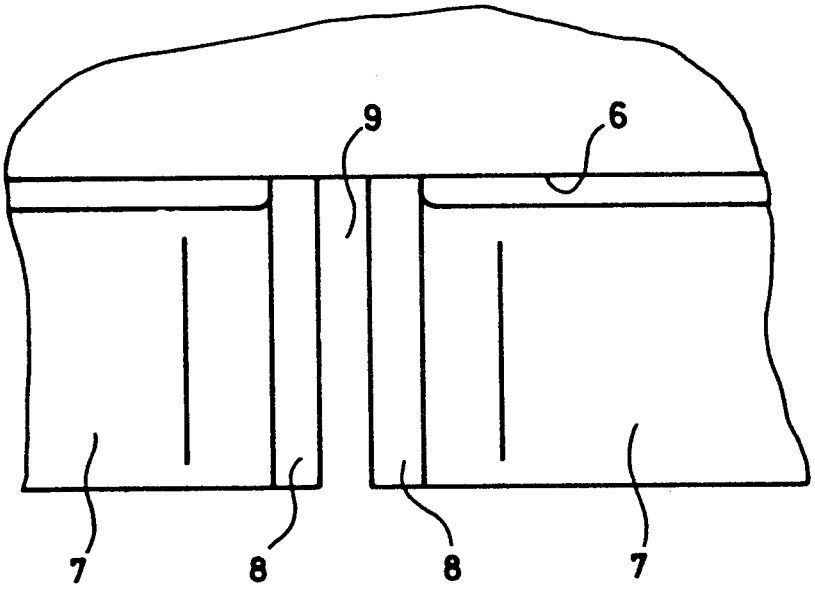
FIG. 5 shows a side view of the two holding web portions.

FIGS. 3 to 5 show in detail the configuration of the closure cap according to the invention. Disposed between the individual desired-rupture web portions 5 are reinforcements 7, the effect of which has already been described in detail in laid-open European application No. 34 997. Therefore, the guarantee strip 4, over the entire periphery thereof, alternately comprises reinforced or thickened regions and thinner regions. Two substantially parallel holding web portions 8 are disposed in the area between two reinforcements 7, and the cross-section of the holding web portions together is larger than the cross-section of a single desired-rupture web portion 5. The guarantee strip 4 is interrupted between the two holding web portions 8 so as to form a substantially vertical slot 9. As can be seen in particular from FIG. 4, the guarantee strip 4 is of substantially wedge shape in cross-section. The two holding web portions 8 are of substantially the same wall thickness as the widest part of the wedge-shaped guarantee strip 4 so that the holding web portions do not additionally increase the thickness of the guarantee strip. The holding web portions are advantageously substantially semicircular in cross-section.

In order to illustrate the dimensional relationships of the closure cap, a few measurements are set out by way of example hereinafter. The width of the two holding web portions 8 is 0.9 mm, and their wall thickness (radius) is 0.45 mm which is at the same time the wall thickness of the guarantee strip 4 between two reinforcement portions 7. The width of the slot 9 between two holding web portions is 0.5 mm. The individual desired-rupture web portions 5 are also of semicircular cross-section but their radius is only 0.2 mm. The reinforcements 7 extend over sections of about 30°, while their wall thickness is 0.6 mm. The reinforcement portions 7 also taper towards the lower edge 6 of the closure cap 1. The height of the guarantee strip 4 is about 4.5 mm. All the specified dimensions relate to a closure cap for a drinks bottle with an MCA-standard mouth.

The two holding web portions 8 approximately correspond together in cross-section to the web of material which was previously used as the reinforced region. However, by virtue of being divided into two web portions which are completely separate from each other, the guarantee strip can be easily pulled off the closure cap. Nonetheless, the arrangement ensures that it is always the desired-rupture web portions 5 that tear first, and that the guarantee strip initially remains joined to the closure cap, when unscrewing the cap. At any event, the slot 9 between the two holding web portions 8 ensures that the guarantee strip 4 does not remain on the neck 3 of the container. More specifically, if once the two holding web portions 8 should tear together with the desired-rupture web portions 5, the guarantee strip 4 virtually falls off the neck 3 of the container, of its own accord, as it does not form a ring but only an open loop. Therefore, the configuration according to the invention is of service not only to the filler of the container, as a result of the better shrink qualities and the greater ease of cleaning the containers when they are returned, but also the consumer who can easily pull the guarantee strip off the closure cap if the guarantee strip has not already been torn away from and fallen off the closure cap, of its own accord, when unscrewing the closure cap.

The advantages that can be achieved with the invention are also enjoyed in the case of the guarantee strips which can be mechanically engaged in position, and in regard to which approximately the same conditions in respect of the forces involved occur, as in the case of shrink-fitted guarantee strips, when the screw cap is unscrewed for the first time.

I claim:

1. A closure cap for a container, which is provided with a guarantee strip that can be brought into engagement with the neck of the container, and which is made in one piece with the guarantee strip from thermoplastic material by an injection moulding process, wherein the guarantee strip is joined to the lower edge of the closure cap by way of a multiplicity of desired-rupture web portions and by way of a reinforced region and the wall thickness of the guarantee strip has a reinforcement in the area between each two desired-rupture web portions, characterised in that the reinforced region comprises two substantially vertically extending holding web portions (8) and that the guarantee strip is interrupted between the holding web portions.

2. A closure cap as set forth in claim 1 characterised in that the cross section of the two holding web portions together is larger than that of a single desired-rupture web portion (5).

3. A closure cap as set forth in claim 1 characterised in that the two holding web portions are arranged in the area between two reinforcements (7) on the guarantee strip (4).

4. A closure cap as set forth in claim 3 characterised in that the two holding web portions are of substantially the same wall thickness as the guarantee strip.

5. A closure cap as set forth in claim 2 characterised in that the two holding web portions are arranged in the area between two reinforcements (7) on the guarantee strip (4).

6. A closure cap as set forth in claim 5 characterised in that the two holding web portions are of substantially the same wall thickness as the guarantee strip.

* * * * *